United States Patent [19]

Weickert et al.

[11] Patent Number: 4,742,770

[45] Date of Patent: May 10, 1988

[54] VARIABLE FIELD CREDIT CARD IMPRINTER WITH DISABLING MECHANISM

[75] Inventors: Walter R. Weickert, Petersburg; Paul J. Foley, Kitchener, both of Canada

[73] Assignee: National Business Systems,Inc., Canada

[21] Appl. No.: 701,683

[22] Filed: Feb. 14, 1985

[51] Int. Cl.[4] ..... B41J 3/04

[52] U.S. Cl. ..... 101/269; 101/45

[58] Field of Search ..... 101/269, 45, 56, DIG. 18, 101/270–274

[56] References Cited

U.S. PATENT DOCUMENTS

| | | | |
|---|---|---|---|
| 3,322,062 | 5/1967 | Maul | 101/45 |
| 3,334,582 | 8/1967 | Mahoney | 101/269 |
| 3,405,634 | 10/1968 | Maul et al. | 101/269 |
| 3,515,060 | 6/1970 | Barbour | 101/45 |
| 3,838,640 | 10/1974 | Correll et al. | 101/269 |
| 3,945,316 | 3/1976 | Thomson et al. | 101/45 |
| 4,324,178 | 4/1982 | Barbour | 101/45 |
| 4,393,768 | 7/1983 | Barbour | 101/45 |
| 4,401,029 | 8/1983 | Barbour | 101/269 |

FOREIGN PATENT DOCUMENTS

| | | | |
|---|---|---|---|
| 2133744 | 8/1984 | United Kingdom | 101/D18 |

*Primary Examiner*—Edgar S. Burr
*Assistant Examiner*—Tonya Lamb
*Attorney, Agent, or Firm*—Antonelli, Terry & Wands

[57] ABSTRACT

A variable field imprinter is provided including a platen carriage adapted to be reciprocated over an imprinting surface and then locked in a position to one side of the imprinting surface by a releasable blocking system. The blocking system consists of (i) a platen carriage blocking mechanism and (ii) a digit wheel sensing mechanism these two mechanisms must be interconnected by a credit card. Resetting of at least one of the digit wheels provides a force from the digit wheel sensing mechanism which is transmitted by the credit card to the platen carriage blocking mechanism to disarm the blocking system so that the platen carriage can be moved for imprinting.

3 Claims, 2 Drawing Sheets

VARIABLE FIELD CREDIT CARD IMPRINTER WITH DISABLING MECHANISM

BACKGROUND OF THE INVENTION

1. Field of the Invention

The present invention relates generally to devices for imprinting fixed and variable information on business forms and similar documents, and is particularly concerned with a platen disabling mechanism to prevent double imprinting. The platen disabling mechanism of the present invention is disarmed only when a credit card is positioned on the imprinter bed and at least one of the variable imprinting indicia on the imprinter has been reset. After the imprinting the disabling mechanism prevents further imprinting until again disarmed.

2. Description of the Prior Art

Variable imprinting devices for transferring to a printed form the fixed and variable information relating to a business transaction are well known and have been in general use in various types of retail establishments for many years. Typically, the purchaser presents the retailer with a plastic credit or charge card, upon which are embossed the customer's name, address, account number, and other pertinent information in raised numerals and letters. The vendor places the card together with a prepared form containing one or more carbon duplicates, onto the imprinting device. Generally, the imprinter also includes an affixed metal plate (sometimes referred to as the "merchant plate"). On this metal plate are embossed the name, address and other pertinent information of the retail establishment in raised numerals and letters, so that this information can also be transferred to the form by imprinting. In addition to the "fixed " type of information, as embossed on cards, in some cases, the date of the transaction as set on printing wheels mounted adjacent to the printing surface is also transferred to the form by the imprinter. The remaining "variable " information, such as the price of the goods or services purchased, the applicable taxes, and so on, is set on the machine before the imprinting operation is carried out, and is transferred by imprinting to the form along with the customer's account information, and the name and location of the vendor establishment. The imprinting of variable information is usually done by means of an adjustable set of printing or digit wheels which are brought into contact with the form during the imprinting operation. A common arrangement for setting the variable information is to install a digit wheel assembly within the imprinter housing so that it protrudes slightly through a slot or cut-out in the print bed. Adjustment of the digit wheel settings is usually accomplished by means of slidable tabulator keys or rotatable thumbwheels.

The imprinting of both the fixed and variable data onto the forms is accomplished by the passage of one or more platens across the surface of the forms with the underlying embossed cards and the set digit wheels. To move the platens over the forms, the platens are mounted on a carriage which is further mounted for slidable movement along the bed of the imprinter on which a form and the embossed cards and digit wheels are positioned. The carriage is moved from a starting position across the surface of a form, and then is moved back to the starting position.

Unrestricted movement of the platen carriage over a form with both an underlying customer credit card and digit wheels however, can result in inadvertent double imprinting, i.e. a first imprinting of the form with fixed and variable data followed by a second imprinting on the same form or on a different form of the same data. The imprinting of the same variable data results from not rotating at least one of the digit wheels prior to the second imprinting. Such double imprinting on a second form can result in an inaccurately imprinted form with the inaccurate charge information being recorded in an accounting system against the credit account of the second card holder. Whereas, the double imprinting of the same form with the same data often results in a uselessly imprinted form, because the double imprinting often causes double images or smudging. Since at least one of the imprinted sheets must be machine-readable, it is important that the imprinting of data on the form be accomplished without smudging. Therefore, a double imprinting of the same data on the same form invariably results in a smudged or double image which renders the form useless.

Another possible cause for error in imprinting forms is the inadvertent failure of the imprinter operator to position the customer's credit card under the form for imprinting. Then the imprinted form fails to include the customer's account information.

Failing to reset variable data between imprintings, or failing to assure mounting of a credit card on the imprinter bed are problems which previously have been individually recognized in the design of imprinters. For example, a variable imprinter with a disabling mechanism armed to prevent double imprinting of the same variable data and disarmed after resetting of at least one of the variable data print wheels is disclosed in co-pending U.S. patent application Ser. no. 560,409, now abandoned entitled "Variable Field Imprinter With Disabling Means", filed by Walter Weickert on Dec. 12, 1983. In this patent application an imprinter is disclosed where the platen carriage on being returned to the starting position for imprinting arms the disabling mechanism and rotation of a variable data print wheel disarms the disabling mechanism.

Another type of imprinter disabling mechanism is disclosed in co-pending U.S. patent application Ser. no. 306,495, now U.S. Pat. No. 4,651,642 entitled "A Credit Card Imprinter With Disabling Means", filed by David E. Gravelle on Sept. 28, 1981, as a continuation application from Ser. No. 91,308 filed on Nov. 5, 1979. In this patent application an imprinter, which may not have variable data imprinting capability, is disclosed where the platen carriage is prevented from being moved from the starting position to make an imprinting if a credit card is either not positioned for imprinting on the imprinter bed or is incorrectly positioned for imprinting.

SUMMARY OF THE INVENTION

The present invention provides an improved hand-operated two stroke, flat bed variable imprinter with an effective disabling mechanism for preventing imprinting unless (i) a credit card is properly positioned on the imprinter bed, and (ii) there has been a resetting of at least one of the variable data print wheels after the last imprinting. The platen carraige disabling mechanism of the present invention, therefore, alerts the operator to position a credit card on the imprinter for imprinting and to reset the digit wheels for the next imprinting.

The platen carriage of the present invention is mounted on bearing wheels with respect to the upper surface of the imprinter bed where a form is positioned for imprinting. Two platens are reciprocally mounted on the platen carriage of a preferred embodiment for the present invention. When the platen carriage is moved from one side of the flat bed, i.e. from a starting position, to the other, one of the platens is brought into an imprinting position while the second platen is moved over the form but is not retained in a position for imprinting data on the form. This imprinting relationship for the platens is reversed when the platen carriage is returned to the starting position. Thus, at the end of the second stroke of the platen carriage both platens have been moved over the form so as to imprint the data from the credit cards and digit wheels on the form.

Before the platen carriage can be moved from the starting position for imprinting, however, a credit card must first be positioned on the imprinter bed so as to both be in a position for imprinting and to provide a mechanical linkage between a platen carriage blocking mechanism and a digit wheel sensing mechanism. Such positioning of a credit card does not disengage the blocking system, which consists of the combination of the platen carriage blocking mechanism and the digit wheel sensing mechanism, from preventing movement of the platen carriage. Disengagement of the blocking system, after positioning of a credit card to mechanically link the platen carriage blocking mechanism and the digit wheel sensing mechanism, is accomplished by resetting at least one of the digit wheels. Each of the digit wheels, in a preferred embodiment, is rotationally positioned via an associated rack. The underside of each rack having teeth positioned so as to accept a detent spring which controls the rotational position of the associated digit wheel to assure proper alignment of the raised indicia for imprinting. Therefore, when a rack is moved the detent spring is forced downward with respect to the imprinter bed as each tooth on the back of the rack passes over the detent spring. This downward movement of the detent spring also moves a wire bail downward. One end of the bail wire is pivotally mounted to accommodate the downward movement of the bail wire and the other end is connected to the tab of a latch associated with the digit wheel sensing mechanism. As the bail wire is rotated about its pivot by the movement of a rack the connected latch pulls a locking projection out of a lever also associated with the digit wheel sensing mechanism allowing the lever and a plunger to move in response to a spring against the positioned credit card. This force on the credit card is transferred by the credit card to a plunger associated with the platen carriage blocking mechanism which in turn rotates a stop arm that removes a blocking tab from obstructing movement of the platen carriage.

Now the platen carriage can be moved to make an imprinting. However, as the platen carriage moves over the digit wheel sensing mechanism the same tab on the platen carriage which is used to abut the blocking tab of the platen carriage blocking mechanism strikes a projection on the top of the plunger associated with the digit wheel sensing mechanism causing that plunger to be moved away from the platen carriage starting position and to compress the spring acting against movement of the plunger. This movement of the plunger causes the latch of the digit wheel sensing mechanism to again catch into a notch in the lever of the digit wheel sensing mechanism. Accordingly the credit card no longer removes the blocking tab of the platen carriage blocking mechanism from obstructing movement of the platen carriage from the starting position. However, the platen carriage can be returned to the starting position because the shape of the stop arm of the platen carriage blocking mechanism and its retention in the blocking position by the force of a leaf spring permits the stop arm to be moved out of the blocking position by the platen carriage being moved back into the starting position. As the platen carriage moves back into the starting position, though, the stop arm with the blocking tab is again repositioned by the leaf spring to obstruct movement of the platen carriage from the starting position.

BRIEF DESCRIPTION OF THE DRAWINGS

These and other objects, advantages and novel features of the present invention will be more readily apprehended from the following detailed description when read in conjunction with the appended drawings, in which.

Throughout the drawings, the same reference numerals have been used to designate like parts.

DETAILED DESCRIPTION OF THE INVENTION

Figure 1:
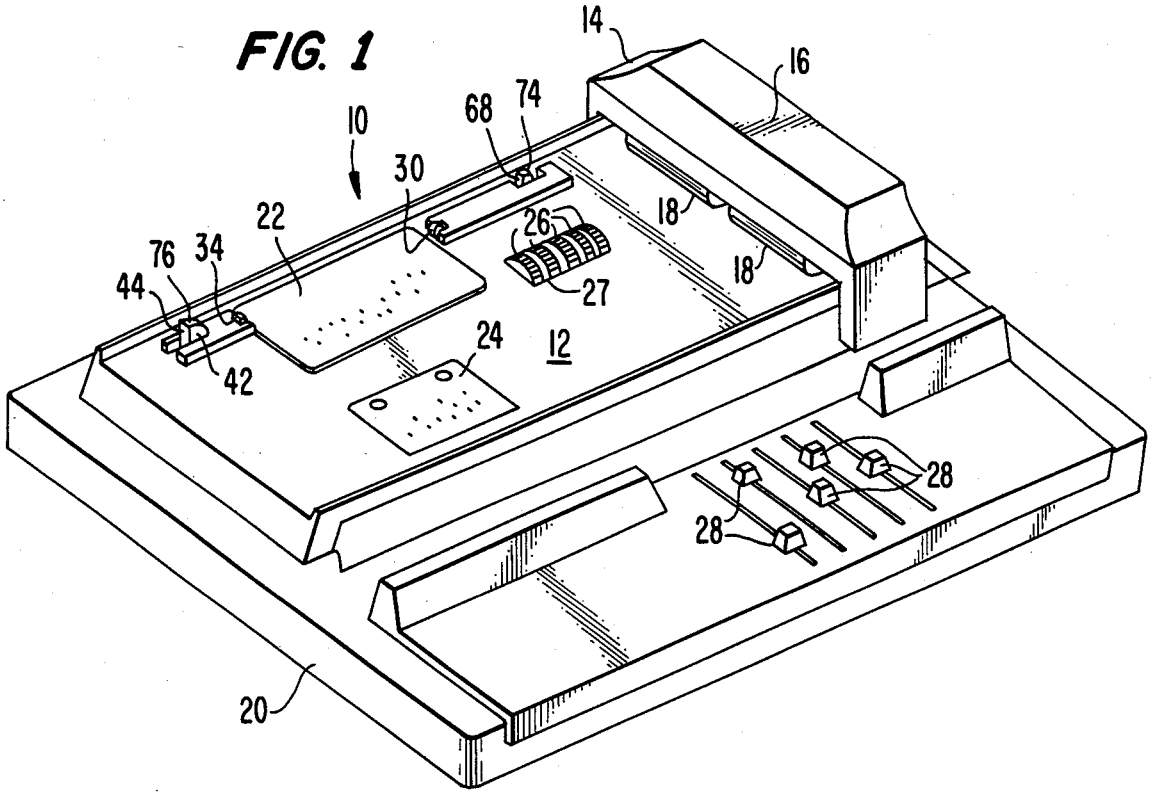
FIG. 1 is a top perspective view of a variable imprinting unit constructed in accordance with the principles of the present invention.

A variable imprinting unit 10 constructed in accordance with the principles of the present invention is illustrated in a top perspective view shown in FIG. 1. The imprinting unit 10 comprises a generally flat upper surface 12 for supporting a form or document to be printed (not shown), and a platen carriage 14, which is on the opposite side of the flat upper surface from the starting position to show major features of the imprinter. The horizontal portion 16 of the platen carriage 14 carries two rotatably mounted platen rollers 18 having axes transverse to the sliding direction of the platen carriage 14.

With reference to FIG. 1, the upper document supporting surface 12 of the imprinter base 20 is provided with a recess for receiving a customer credit card 22. Also shown on the upper document supporting surface is an affixed merchant plate 24 which will normally be embossed with the name and location of the retail merchant. A set of digit wheels 26, five of which are shown in the illustrated embodiment, protrude upwardly through a rectangular cut-out 27 that is formed in the upper surface 12 of the base enclosure 20. The five digit wheels 26 are adjusted by means of a set of tabs 28 that are slidably moveable on the front portion of the base enclosure 20. It is to be understood, of course, that a greater or lesser number of digit wheels 26 and tabs 28 may be provided, depending upon the desired data recording capacity of the imprinting unit.

Figure 2:
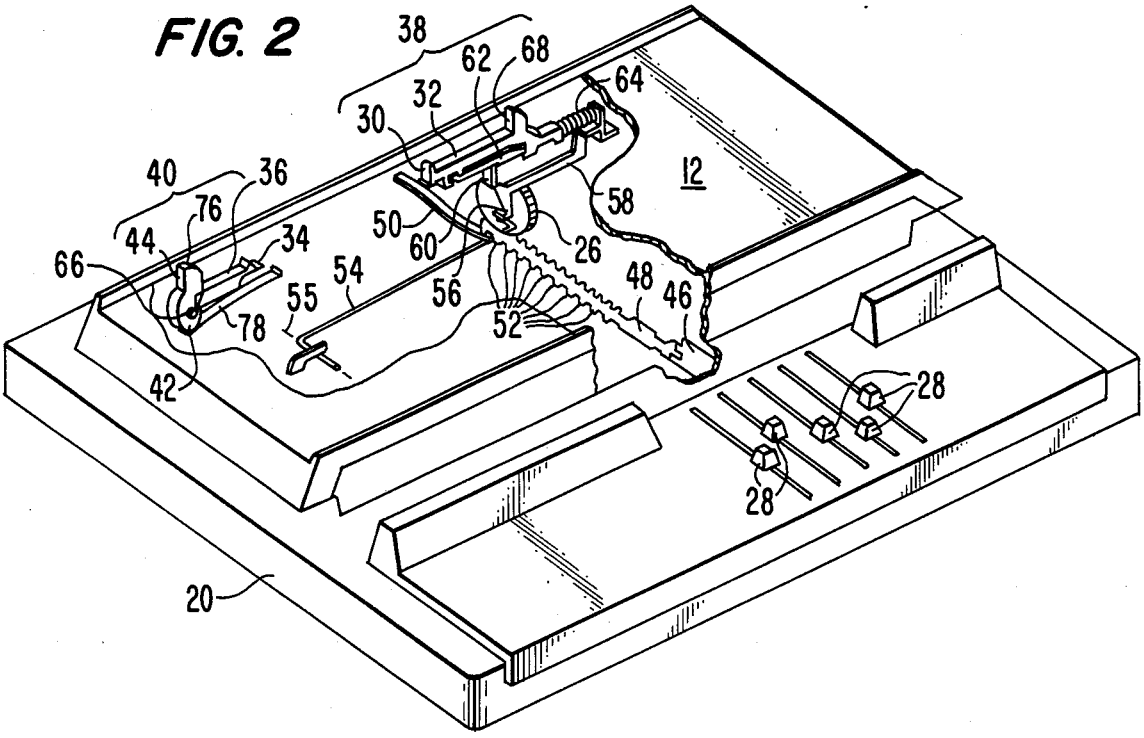
FIG. 2 is a partial cutaway perspective view of the imprinter unit of FIG. 1, without a platen carriage, showing the digit wheel sensing mechanism and the platen carriage blocking mechanism; and, FIG. 3 is a plan view of the plunger with associated lever and cushion flat spring of the digit wheel sensing mechanism.

In order to make an imprinting on a form a credit card 22 must first be positioned on the flat upper surface 12 of the imprinting unit 10 as shown in FIG. 1. When the credit card 22 is so positioned, it is mounted against both the credit card tab 30 of plunger 32 (see FIG. 2) and the credit card tab 34 of plunger 36 (see FIG. 2). Plunger 32 is associated with a digit wheel sensing mechanism 38, and plunger 36 is associated with a platen carriage blocking mechanism 40 (see FIG. 2). Thus the credit card 22 provides a mechanical linkage between the digit wheel sensing mechanism 38 and the platen carriage blocking mechanism 40. This linkage, however, does not remove the stop arm 42 with its blocking tab 44 from obstructing movement of the platen carriage 14 from the starting position by the abutting interaction of blocking tab 44 and a platen carriage tab (not shown).

Figure 3:
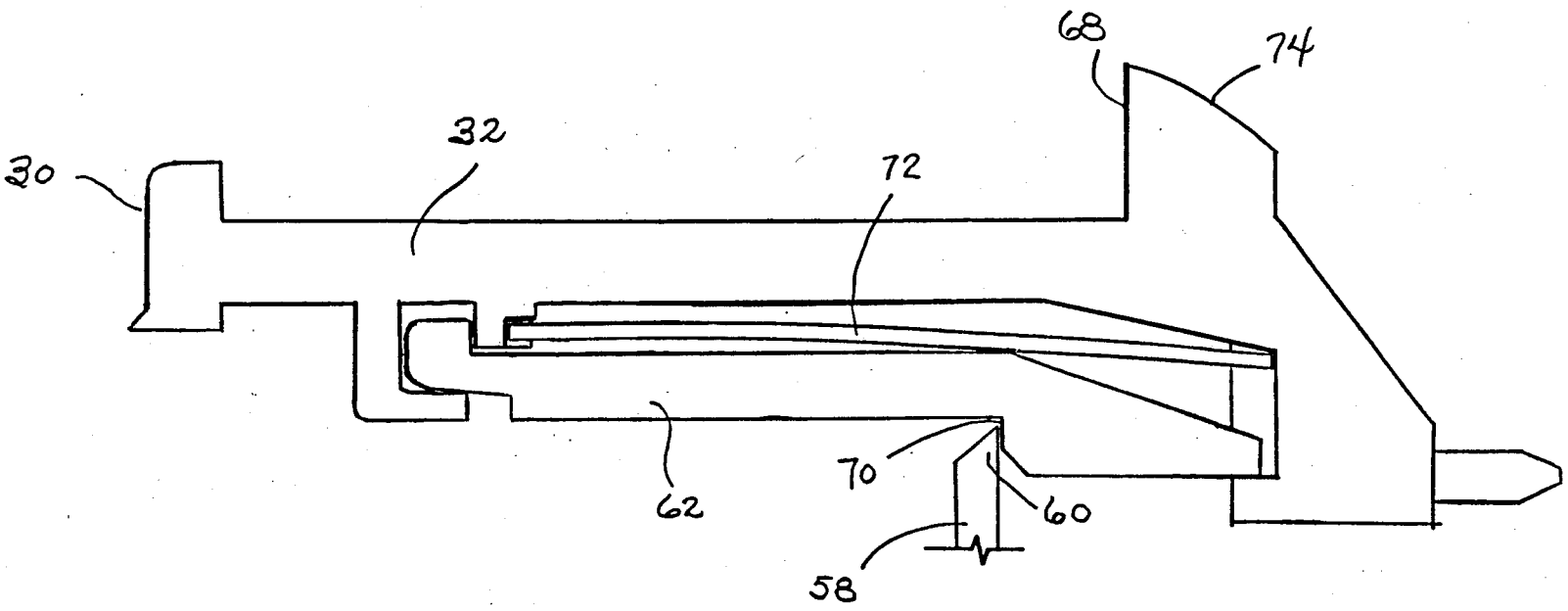

To remove the blocking tab 44 from obstructing movement of the platen carriage 14 at least one of the digit wheels 26 must be reset. A digit wheel 26 can be reset by the operator moving the associated tab 28 which moves an associated actuator bar 46 and the interconnected rack 48. Movement of a rack 48 causes a detent spring 50 to be moved downward with respect to the flat upper surface 12 of the imprinter 10 because of the teeth 52 projecting from the under side of each of the racks 48. The interrelationship of the detent spring 50 and the rack teeth 52 provides a system for rotationally positioning the digit wheels 26 in proper orientation for the indicia on the digit wheels 26 for imprinting. As a detent spring 50 is moved downward by a tooth 52 on a rack 48 the detent spring 50 transfers downward movement to a wire bail 54 which is pivotally mounted about pivot axis 55 and which in turn transfers downward movement to tab 56 of latch 58. This downward movement of latch 58 removes a locking projection 60 out from a lever 62 (also see FIG. 3) allowing the lever 62 and the plunger 32 in which the lever 62 is mounted to move toward the platen carriage blocking mechanism 40 as a result of the force provided by a spring 64 acting against the plunger 32. As the plunger 32 moves toward the platen carriage blocking mechanism 40 the credit card 22 transfers this force to the plunger 36 of the platen carriage blocking mechanism 40 which causes the stop arm 42 to pivot about axis 66 and thereby lower blocking tab 44 from obstructing movement of platen carriage 14.

Now the operator can move the carriage to make an imprinting. As the platen carriage 14, on the first stroke, moves past the digit wheel sensing mechanism 38 the platen carriage tab abuts a projection 68 on the top of the digit wheel sensing mechanism plunger 32 causing the plunger 32 to be forced away from the platen carriage 14 starting position, i.e. in the same direction the platen carriage 14 is being moved. This movement of plunger 32 compresses spring 64 and permits the locking projection 60 of latch 58 to be repositioned into a notch 70 on the lever 62 of the digit wheel sensing mechanism 38. Accordingly, with the digit wheel sensing mechanism plunger 32 restrained by the interconnection of the latch 58 and the digit wheel sensing mechanism plunger lever 62, the credit card is no longer transmitting the force from spring 64 to the platen carriage blocking mechanism plunger 36 which had lowered the blocking tab 44. Therefore, the blocking tab 44 is again raised to its blocking position.

Upon the interconnection of the latch 58 and the digit wheel sensing mechanism plunger lever 62 the platen carriage 14 can continue its first stroke movement because the projection 68 on further movement of plunger 32 against spring 64 is lowered from the platen carriage as a result of compression of flat spring 72 which acts as a cushion between the plunger 32 and the lever 62 for lowering projection 68 from abutting contact with the platen carriage tab. (see FIG. 3) On the return to the starting position or second stroke of the platen carriage 14 the curved surface 74 of the projection 68 on the plunger 32 in combination with the cushion flat spring 72 permits the platen carriage 14 to pass over the digit wheel sensing mechanism plunger 32 without unlatching the digit wheel sensing mechanism plunger lever 62 and the latch 58. Similarly, the curved surface 76 on the stop arm 42 in combination with the flat spring 78 acting against the stop arm 42 permits the stop arm 42 to be momentarily moved out of the way of the platen carriage 14 so that the platen carriage 14 can be returned to its starting position and the blocking tab 44 can be then returned to its obstructing position by flat spring 78.

The above discussion and related illustrations of the present invention are directed primarily to a preferred embodiment and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

What is claimed is:

1. A platen carriage locking mechanism for a variable information imprinter comprising:

(i) a platen carriage mounted on said imprinter for movement from a starting position, across a customer credit card and a set of moveable digit wheels, to an end position, and from said end position back to said starting position;

(ii) a platen carriage blocking means for blocking movement of said platen carriage from said starting position, and for permitting movement of said platen carriage from said starting position;

(iii) a digit wheel sensing means which provides movement of the credit card after the resetting of at least one digit wheel; and (iv) said credit card being positioned between said platen carriage blocking means and said digit wheel sensing means to connect said digit wheel sensing means to said platen carriage blocking means so that said platen carriage blocking means is configured to permit movement of said platen carriage from said starting position before imprinting across said customer credit card in response to the resetting of at least one digit wheel.

2. A platen carriage locking mechanism in accordance with claim 1, wherein said digit wheel sensing means includes means to interact with said platen carriage when said platen carriage is being moved to said end position to reconfigure said platen carriage blocking means to prevent movement of said platen carriage from said starting position.

3. In a platen carriage locking mechanism for a variable information imprinter having a platen carriage mounted on the imprinter for movement from a starting position, across a customer credit card and a source of variable information to an end position and from the end position back to the starting position, a platen carriage blocking means for blocking movement of the platen carriage and for permitting movement of the platen carriage from the starting position, and means for sensing movement of the source of variable information by causing a movable member to move, the improvement comprising:

means to connect the movement of said movable member to the platen carriage blocking means to cause the platen carriage blocking means to permit movement of the platen carriage from the starting position said means to connect comprising the credit card.

* * * * *